United States Patent [19]

Findlay

[11] 4,003,469

[45] Jan. 18, 1977

[54] CONVOLUTE FOAM PACKAGE

[75] Inventor: Allan Cameron Findlay, Davidson, N.C.

[73] Assignee: Reeves Brothers Inc., New York, N.Y.

[22] Filed: Jan. 29, 1976

[21] Appl. No.: 653,488

[52] U.S. Cl. ..... 206/410; 206/83.5
[51] Int. Cl.[2] ..... B65D 85/672
[58] Field of Search ..... 206/410, 83.5

[56] References Cited

UNITED STATES PATENTS

| | | | |
|---|---|---|---|
| 2,270,043 | 1/1942 | Fourness et al. | 206/410 |
| 3,437,197 | 4/1969 | Wirfel | 206/410 |

*Primary Examiner*—George T. Hall
*Attorney, Agent, or Firm*—Bell, Seltzer, Park & Gibson

[57] ABSTRACT

A convolute package of flexible foam sheet material which is highly compact to facilitate shipment and storage, and which has substantially uniform layer to layer compression within predetermined limits consistent with the desired compression of the overall package and without detrimental over-compression of any layers. Further, the material in the package is dimensionally stable upon the unwinding of the package to permit the immediate use thereof, such as die stamping components of predetermined size therefrom.

6 Claims, 12 Drawing Figures

CONVOLUTE FOAM PACKAGE

The present invention relates to a highly compact convolute package of flexible foam sheet material which exhibits several surprising and novel physical characteristics, and wherein the layers in the package are substantially uniformly compressed. In this regard, the present invention represents an improvement of the invention described and claimed in the pending application of George A. Watson, Ser. No. 625,118, filed Oct. 23, 1975 and entitled "Convolute Foam Package and Method of Forming Same". Reference is also made to the present applicant's copending application Ser. No. 653,483 entitled "Method and Apparatus for Forming Convolute Foam Package" filed concurrently herewith. These copending applications are commonly owned herewith, and are incorporated herein by reference.

In the manufacture of flexible foam sheet material, it is conventional to wind an elongate web of the material into a wound cylindrical roll as a final production step, and then to compress or densify the roll to reduce its bulk and thereby facilitate shipment and storage. In a heretofore widely used process, the cylindrical roll of foam is enclosed in an air tight plastic bag, and the air is then withdrawn from the bag to radially compress the roll and reduce its diameter. The bag is then sealed, and a non-extensible paper wrapper is positioned about the roll to serve as a binder for maintaining its compressed configuration. By use of this procedure, a reduction in the volume of the roll to approximately 30 to 40 percent of its original volume is possible, but the efficiency of the process is limited by reason of the fact that the resulting package usually has a non-uniform external configuration. More particularly, the vacuum not only compresses the roll radially, but also compresses it axially, thereby resulting in non-uniform enlargements at the ends of the package. The enlarged ends in turn limit the ability to closely group the resulting packages for transportation and/or storage, thereby decreasing the overall efficiency of the densification process.

The conventional vacuum forming procedure as described above has a further significant limitation in that wrinkles are formed in the foam layers which result from a gathering of the foam in both the length and width directions during the compaction process. These wrinkles tend to remain in the material for a period of time after the roll is unwound due to the hysteresis phenomenon. This recovery lag is particularly pronounced where the roll is maintained in compacted condition for an extended period, as where the roll is shipped to a distant location, and the lag prevents the immediate use of the material in many instances, such as where it is desired to immediately die stamp critically dimensioned component parts from the web.

Another significant disadvantage of the above described vacuum forming process lies in the fact that the compressive forces exerted on the roll by the paper binder are substantial, and an accidental rupture of the binder results in an explosive release of these forces. As will be apparent, the potential for an explosive release of this type presents a serious saftey hazard and could cause extensive damage, such as where the wound package is closely surrounded by similar packages during transit.

Another known method of densifying rolls of foam sheet material employs mechanical means for radially compressing the wound roll, after which a paper binder is wrapped and secured about the roll. This procedure does not tend to axially compress the roll, but it otherwise possesses the same limitations and disadvantages noted above with respect to the present vacuum process.

Still another procedure for reducing the bulk of highly elastic foam sheet material to facilitate its shipment and storage involves tensioning and stretching the material in the lengthwise direction as it is being wound into a roll, such that the material is wound in a thinned and stretched condition. This procedure is able to achieve a relatively high degree of densification, and the resulting package would not tend to explosively expand. However, the thus formed package is like a tightly wound coil spring, and would tend to immediately unwind when the circumferential binder is removed. Also, the stretching procedure results in a significant lengthening of the foam material in the longitudinal direction, as well as a reduction in its width in approximation with Poisson's ratio. Thus the package is difficult to handle even with a binder, and the material requires a significant period of time to return to its original dimensions after unwinding, which as noted above, precludes its immediate use in many instances. Further, the stretching procedure is not available for non-extensible materials, such as foam materials which have a relatively non-extensible scrim laminated thereto.

It has also been proposed to wind flexible foam sheet material on a machine which incorporates a pair of cradle rollers for supporting the foam roll therebetween during the winding process, and wherein pressure is exerted downwardly on the wound roll by a third roller riding on the upper surface of the roll. The three rollers employed in this apparatus are deeply grooved to permit the rollers to mesh at the start of the winding operation, with the grooves being about 2 inches wide and 2 inches deep. This winding apparatus is able to reduce the thickness of the foam layers possibly by as much as 25 percent, and thus it achieves a limited degree of compaction in the resulting wound package, but insofar as can be determined, the apparatus is not able to achieve that degree of compaction which is necessary to significantly reduce the volume of the package and thereby materially facilitate shipment and storage.

In the above referenced copending Watson application, Ser. No. 625,118, the above described problems associated with the foam packages of the prior art are solved by the provision of a convolute package which comprises a predetermined length of highly compressible, flexible foam sheet material arranged in a plurality of convolute layers, and with the layers being substantially wrinkle-free and having a width dimension closely corresponding to the width of the material in unwound non-compacted form. The layers are compressed such that they have a thickness substantially less than three-quarters of the thickness of the non-compacted sheet material, and the volume of the package is substantially less than nine-sixteenths the volume the package would occupy in a non-compacted wound form.

The above package is produced in accordance with the method of the copending Watson application by advancing an elongate web of flexible foam sheet material into a nip formed between a take-up roller and a supporting roller, while winding the advancing web upon the take-up roller to form a wound package. The web is introduced onto the package at the nip while maintaining the package radius at the nip less than the radius of the remaining periphery of the package, and is compressed to reduce its thickness by substantially more than one-quarter of its original thickness as the web passes through the nip.

The package formed in accordance with the Watson application possesses several physical characteristics and properties which materially enhance its commercial utility. In particular, the package is substantially self-restrained against circumferential expansion and thus it does not tend to explosively expand upon the release of the wrapper or binder. Thus the handling and unwinding of the package is facilitated, and a serious safety hazard is avoided. Further, the package possesses only a limited tendency to unwind when the binding is released, such that in the event of an inadvertent release of the binder, the package remains stationary and will neither roll along the floor or unwind in a spring-like fasion. Additionally, the foam layers in the package are substantially wrinkle free, and unchanged from their original length and width dimensions, such that when the package is unwound, the material is dimensionally stable in the length and width directions and may be immediately used in the formation of components of predetermined size without waiting for the hysteresis recovery which is associated with the prior art packages as noted above.

While the package described in the copending Watson application is seen to provide a satisfactory solution to the above noted problems associated with the prior art foam packages, certain characteristics of the Watson package have prompted improvement efforts. In particular, since the density of the foam often varies from run to run, it is sometimes difficult to achieve package to package consistency in both the length of the foam wound in the package and the outer dimensions of the package. For example, where a less dense foam is wound, the degree of compression would be somewhat greater, and the outer diameter of the resulting package would be smaller for a given length of the foam than would be the case with a more dense foam. The specifications for both the length of the foam in the package and the outer dimensions thereof are often established by the customer or ultimate user, and in this regard, the outer dimensions are usually determined to permit maximum utilization of space within a railway car, truck trailer or the like. Thus, it is desirable to be able to maintain the specified outer dimensions from package to package for packages having a given length of foam therein, to assure proper packing during shipment and storage.

It is also desirable to have uniform layer to layer compression in packages of the described type when attempting to achieve a high degree of compression of the overall package. Otherwise, some layers in the package may be detrimentally over-compressed and other layers under-compressed. Such over-compression may result in a delayed recovery in the thickness of the foam upon the unwinding of the package, thereby precluding its immediate use in certain instances, such as where it is desired to sew a vinyl fabric layer or the like to one or both faces of the foam while the package is being unwound. In such cases, those areas of the resulting product corresponding to the over-compressed layers will be more thin than the remaining areas, since the sewing threads serve to maintain the reduced thickness of the foam. Further, the over-compression can result in a permanent collapse of the cellular structure within such layers to result in permanent variations in the thickness and appearance of the unwound foam.

It is accordingly an object of the present invention to provide a highly compact convolutely wound package of flexible foam sheet material and wherein the package has substantially uniform layer to layer compression within predetermined limits consistent with the desired compression of the overall package and without detrimental over-compression of any layers.

It is another object of the present invention to provide a highly compact convolutely wound package of flexible foam sheet material wherein the length of the foam sheet in the package and outside dimensions of the package may be consistently maintained from package to package.

It is a further object of the present invention to provide a convolute package of flexible foam sheet material which is significantly reduced in volume so as to materially facilitate shipment and storage, which is dimensionally stable in the length and width directions to permit use thereof immediately upon the unwinding of the package, and which is self-restrained against circumferential expansion and which has only a limited tendency to unwind.

These and other objects and advantages of the present invention are achieved in the embodiment illustrated herein by the provision of a convolute package which comprises a predetermined length of highly compressible, flexible foam sheet material arranged in a plurality of convolute layers, and with the layers being substantially wrinkle-free and having a width dimension closely corresponding to the width of the material in unwound non-compacted form. The layers are compressed such that the thickness is substantially uniform from layer to layer within predetermined limits, the thickness being substantially less than three-quarters of the thickness of the non-compacted sheet material, and the volume of the package is substantially less than nine-sixteenths the volume the package would occupy in a non-compacted wound form.

The above package may be produced by advancing an elongate web of flexible foam sheet material into a nip formed between a take-up roller and a supporting roller, and convolutely winding the advancing web upon the take-up roller to form a wound package. The web is introduced onto the package at the nip while maintaining the package radius at the nip less than the radius of the remaining periphery of the package, and is compressed to reduce its thickness by substantially more than one-quarter of its original thickness. In addition, compression of the package layers is maintained within predetermined limits which achieve the desired compression of the overall package and without detrimental over-compression of any layers by controlling the distance between the take-up roller and the supporting roller to a predetermined amount during the winding of the package upon the take-up roller.

Some of the objects of the invention having been stated, other objects will appear as the description proceeds, when taken in connection with the accompanying drawings, in which.

The present invention is described herein with reference to the densification or compaction of an elongate web of flexible foam sheet material, such as polyurethane, other similar open cellular foam material, or other material having a similar low density and a high degree of compressibility. Polyurethane foam is conventionally made in large blocks by reacting a polyisocyanate with a polyol based polyester or polyether. Carbon dioxide gas is generated during the reaction, which causes the reaction mixture to foam and thereby form the cellular structure. Also, a propellant, such as Freon, may be used to reinforce the foaming action. The resulting block of foam is then turned down on a peeler in much the same manner as a lathe, to produce an elongate thin sheet or web having a thickness which typically ranges between one-quarter to one inch or more. If desired, a fabric or scrim may be laminated to one or both faces of the web to provide additional strength. Next, the web is loosely wound into large rolls to facilitate the handling thereof prior to further processing, for example, by cutting the web into components used in the fabrication of seat cushions, mattresses and the like. Where the roll must be stored or shipped prior to further processing, it is common to compress or compact the roll by one of the several methods noted above in order to reduce its volume and thereby facilitate shipment and storage.

Figure 1:
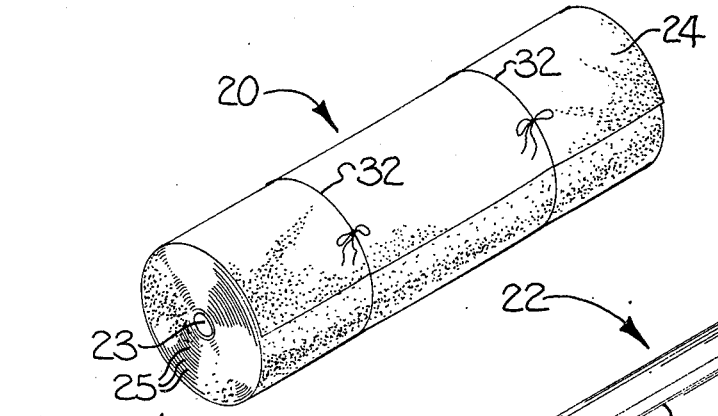
FIG. 1 is a schematic perspective view of a convolute package formed in accordance with the present invention.
Figure 2:
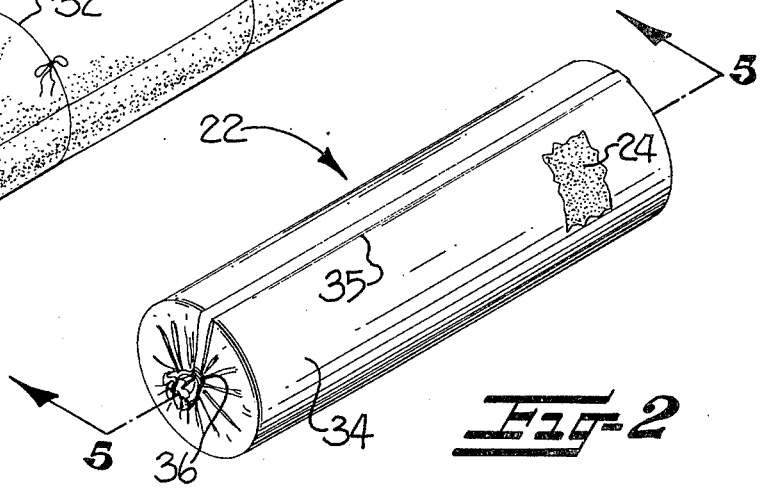
FIG. 2 is a view similar to FIG. 1 but illustrating the package with a thermoplastic sheet wrapper.
Figure 8:
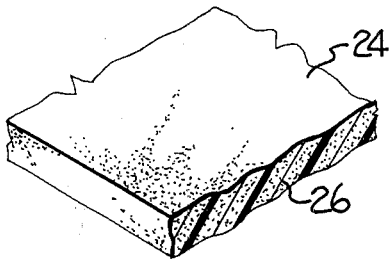
FIG. 8 is an enlarged fragmentary perspective view of a flexible foam sheet material which may be employed in the present invention, and illustrating the same in an unwound, non-compacted condition.
Figure 9:
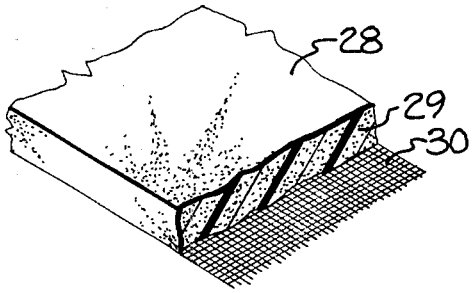
FIG. 9 is a view similar to FIG. 8 but illustrating a different embodiment of the foam sheet material and which includes a reinforcing scrim.

Convolute packages illustrating two embodiments of the present invention are illustrated in FIGS. 1 and 2 at 20 and 22 respectively. Each of these packages comprises a cylindrical core 23, and a predetermined length of flexible foam sheet material 24 coaxially wound into a plurality of convoluted layers 25 upon the core. FIG. 8 illustrates the foam sheet material 24 of the packages 20 and 22 in its relaxed, unwound or flat condition. More particularly, the material 24 comprises a cellular foam layer or sheet 26. FIG. 9 illustrates another embodiment of a foam sheet material 28 suitable for use with the present invention, and which comprises a layer of cellular foam 29 with a layer or sheet 30 of reinforcing material secured to and overlying one face thereof. The reinforcing material typically comprises a fabric, such as lightweight cotton or polyester scrim which is bonded to one face of the foam, by means of either a conventional adhesive or a flame laminating process or the like. In either embodiment, the sheet material typically has a thickness of between one-quarter to one inch or more, and a width up to about sixty inches.

As a specific example, the packages 20 and 22 may be made from sheet material which has a non-compacted thickness of about one-half inch, a width of about sixty inches, and a length of about ninety yards. The sheet material is wound upon a core 23 having a diameter of about 2¼ inches, and the packages have an outer diameter of about two feet.

Figure 3:
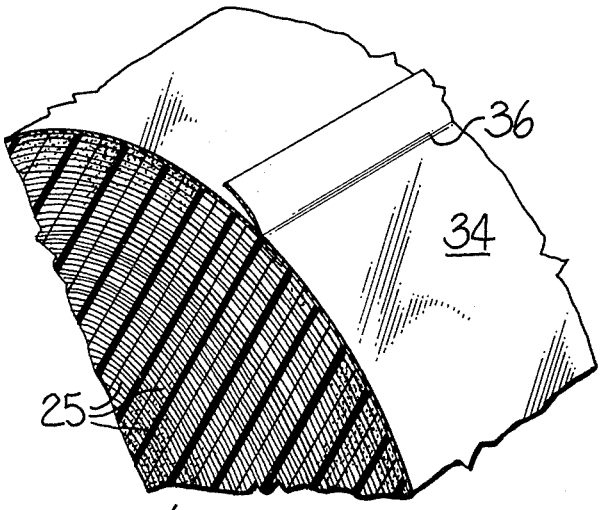
FIG. 3 is an enlarged fragmentary sectional view of the roll shown in FIG. 2 and taken along a plane which is substantially perpendicular to the axis of the roll.
Figure 4:
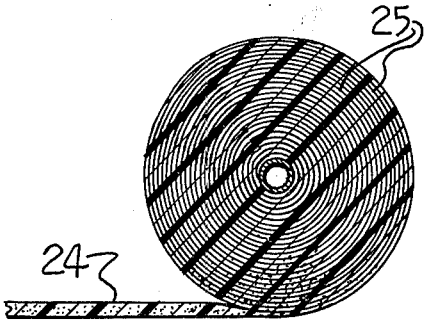
FIG. 4 is an end elevation view of the package of FIG. 1 with the binder released and the roll partly unwound, and illustrating the fact that the roll is stable and does not tend to unwind by rolling along the floor or by a spring-like release.
Figure 5:
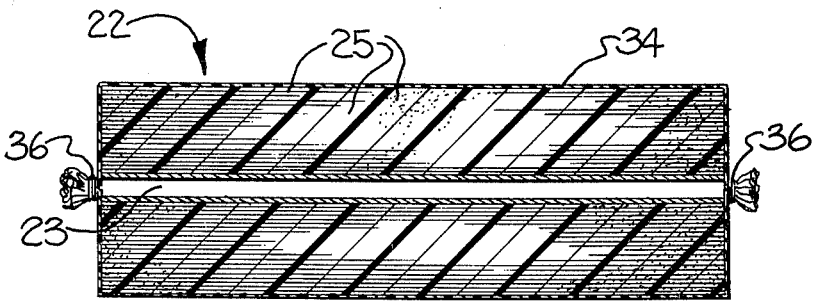
FIG. 5 is a transverse sectional view taken substantially along the line 5—5 of FIG. 2.

As best seen in FIGS. 3–5, the layers 25 are substantially smooth and wrinkle-free, and the length and width dimensions are substantially unchanged from the length and width dimensions of the sheet material in an unwound, non-compacted form. Thus the sheet material is dimensionally stable in the length and width directions upon the unwinding of the roll, and the above noted problems resulting from the recovery lag of the prior art rolls are eliminated. While the actual length of the sheet material in wound package form is not readily measurable, the above stated belief that it is substantially unchanged from its original length is logically verified by actual measurement immediately upon the unwinding thereof.

The convoluted layers 25 of the packages 20 and 22 have a thickness substantially less than three-quarters of the thickness of the non-compacted sheet material, and preferably they have a thickness not greater than about one-half the original thickness. Thus the resulting volume of the package will be substantially less than nine-sixteenths of the volume the package would occupy in a non-compacted, wound form, for example, not greater than one-half the non-compacted volume. Preferably however, the resulting volume will be not greater than about one-quarter of such non-compacted volume. In the above specific embodiment, the layers 25 in the packages 20 and 22 are about one-half the non-compacted thickness of the sheet material 24 (i.e., one-quarter inch), and the volume of each of the packages 20 and 22 is thus about one-quarter of the volume the packages would occupy in a non-compacted, convolutely wound form. While such a 75% reduction in volume is indeed of material significance in facilitating shipment and storage of the package, a reduction in volume of greater than 85% is readily achievable with the present invention. Further, the external configuration of the packages 20 and 22 is a substantially uniform cylinder as seen in FIG. 5, to thereby permit the close grouping of a number of such packages and thereby further facilitate shipment and storage.

As a further aspect of the present invention, it will be apparent from FIGS. 3–5 that the layers 25 in the packages are substantially uniformly compressed from layer to layer to thereby permit maximum compression of the overall package within the ranges noted above, without risk of detrimental over-compression of any individual layers.

The package 20 as shown in FIG. 1 further comprises a pair of flexible cords 32 encircling the outer layer of the sheet material for the purpose of securing the outer layer in its wound condition and precluding the unwinding of the package during transit or storage. Alternatively, the package 22 shows a sheet of flexible plastic film 34 for securing the outer layer of the sheet material, the sheet 34 being heat-sealed along the line 35 in a conventional manner to secure the sheet in position about the package. Also, the edges of the sheet 34 are gathered over the ends of the package and tied or otherwise secured at 36, such that the sheet overlies and protects all surfaces of the package. As will be further described below, the package of the present invention is substantially self-restrained against circumferential expansion, and thus these relatively lightweight binding devices are sufficient to secure the package in its wound condition.

Figure 10:
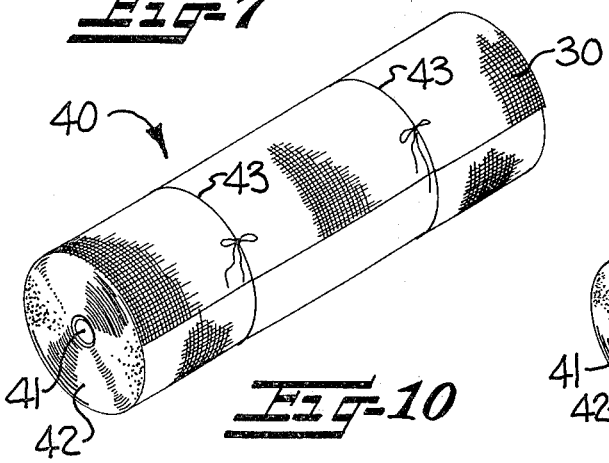
FIG. 10 is a schematic perspective view of still another embodiment of a convolute package formed in accordance with the present invention.

FIG. 10 illustrates another embodiment of a convolute package 40 embodying the present invention. In particular, the package 40 comprises a hollow cylindrical core 41 and a predetermined length of flexible foam sheet material arranged in a pluraltiy of layers 42 upon the core. In this embodiment, the sheet material of the package comprises the above described foam sheet material 28 having a scrim layer 30, and the scrim is positioned on the outside face of the convoluted layers. The package 40 is bound by the cords 43, and is otherwise generally similar to the package 20 shown in FIG. 1.

Figure 11:
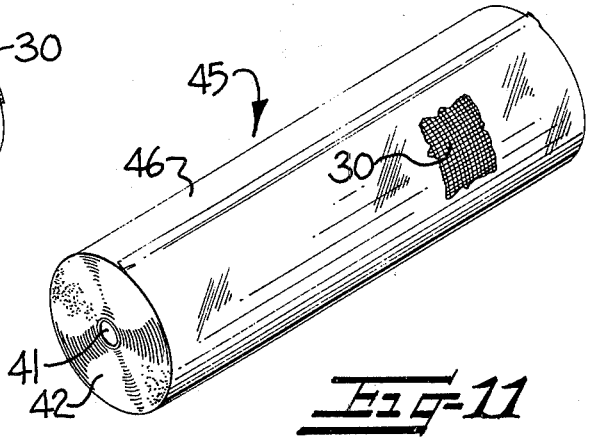
FIG. 11 is a view similar to FIG. 10 but illustrating the package with a thermoplastic sheet wrapper.

FIG. 11 illustrates still another embodiment of the invention, and wherein the package 45 includes a sheet 46 of plastic film which is disposed thereabout to serve as a binder and protective covering. In this case, the plastic sheet 46 overlies only the outer periphery of the package, and not the ends thereof as is the case with the embodiment shown in FIG. 2.

Figure 6:
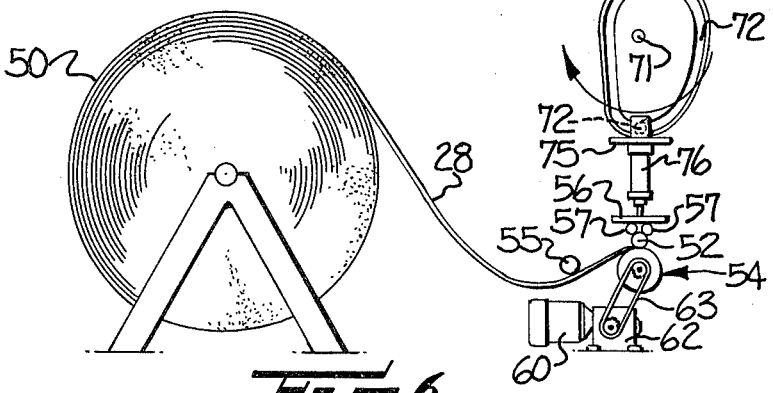
FIG. 6 is a schematic side elevation view of a method and a portion of an apparatus for forming a convolute package of flexible foam sheet material which embodies the present invention, and illustrating the method and apparatus at the commencement of the winding operation.
Figure 6A:
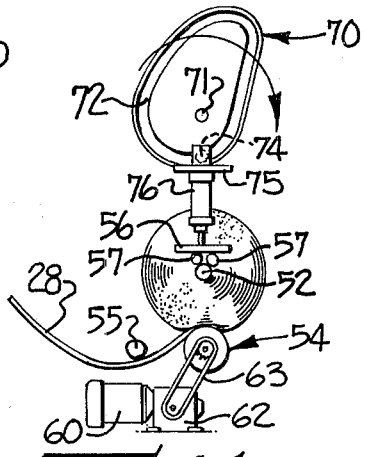
FIG. 6A illustrates the method and apparatus of FIG. 6 at the conclusion of the winding operation.

FIGS. 6 and 6A schematically illustrate a method which is adapted to form the above described novel convolute packages. In particular, the numeral 50 represents a large supply roll which comprises a web of the sheet material 28 which is typically loosely wound into the roll as it leaves the laminator, and which may have a diameter of about 8 feet. The sheet material 28 is advanced along a path of travel from the roll 50 and into a nip formed between a take-up roller 52 and a supporting or driving roller 54, and is guided thereinto by the guide roller 55. In this regard, the sheet material may be advanced by the rotation of the rollers 52 and 54, or by a positive feed means along the path of travel, or by a combination of these and/or other similar means.

In the illustrated embodiment, the take-up roller 52 comprises a solid steel rod of substantially uniform outer diameter of about 1¾ inches throughout its length, and the cylindrical core 23 of paperboard or the like has an outer diameter of about 2¼ inches and is loosely and coaxially disposed over the rod. In addition, the take-up roller 52 is biased downwardly during the winding operation by means of a force which acts through a pair of hold down brackets 56 which rest upon each of the free ends of the roller 52 and as hereinafter further described. Each bracket 56 includes a pair of spaced bearings 57 for contacting the roller 52 while permitting the free rotation thereof, and each bracket is mounted to a supporting framework (not shown) which permits the brackets and roller 52 to vertically lift from the supporting roller 54 as the package builds, while maintaining the vertically directed force thereon.

The supporting roller 54 includes a rubber-like outer surface 59 to facilitate frictional engagement with the sheet material, and it is mounted for rotation about a fixed horizontal axis which is disposed beneath and parallel to the axis of the take-up roller 52. The illustrated embodiment of the roller 54 has a substantially uniform outer diameter of about 6½ inches throughout its length, and it is rotated by a conventional drive means, such as the electric motor 60 which acts through a gear reduction box 62 and the interconnecting chain and sprocket arrangement 63. By this arrangement, rotation is also imparted to the take-up roller and the package being wound thereupon.

Figure 7:
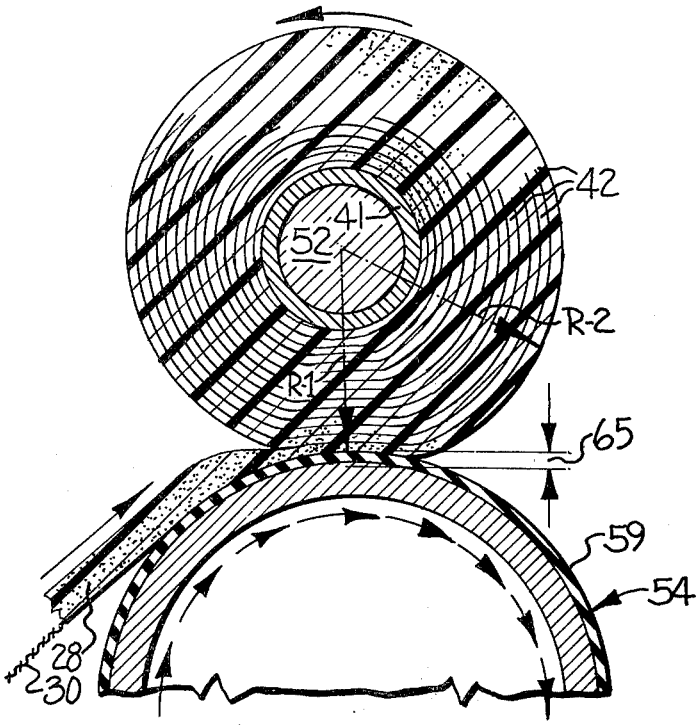
FIG. 7 is a transverse section of the take-up roller and supporting roller as shown in FIG. 6, and illustrating the manner in which the foam sheet material is compressed and wound upon the take-up roller.

Viewing FIG. 7, it will be seen that the advancing web of sheet material is introduced onto the package at the nip, which is located inside of the peripheral outline of the wound package by a distance represented at 65. Thus the radius R1 of the package at the nip is less than the radius R2 of the remaining periphery of the package, and the web is introduced into the nip and is initially brought into contact with the periphery of the package at a point inside of the radius R2. This reduction in radius at the nip results from the fact that the package is depressed across the width thereof at the nip by maintaining the periphery of the package in continuous and forceable contact with the supporting roller 54.

As the web of sheet material 28 passes through the nip, the thickness is reduced by substantially more than one-quarter of its original non-compacted thickness, and preferably by at least about one-half of its original thickness. After passing through the nip, the advancing web is convolutely wound upon the take-up roller 52 to form a wound package thereon, while maintaining substantially the same degree of compression in the web. In view of the fact that the web is advanced into the nip with a substantial absence of longitudinal tension, the sheet material is not elongated or stretched in the longitudinal direction upstream of the nip. Thus upon entering the nip, the web is in a condition wherein its length, width and thickness dimensions closely correspond to these same dimensions when the web is in a fully relaxed, non-compacted form. Since the length and width dimensions are believed to be unchanged when the web is passed through the nip and wound onto the take-up roller for the reasons noted above, these dimensions in the layers of the resulting convolute package will substantially correspond to the original length and width dimensions of the web. Further, the web is seen to be subjected to a certain amount of circumferential tension upon leaving the nip and moving from the radius R1 to radius R2, and it is believed that this circumferential tension in each of the convolute layers 42 helps to retain the compaction of the layers and contributes to the above noted self-restrained nature of the package.

When winding a sheet material 28 of the construction shown in FIG. 9, it is preferable that the sheet material be guided into the nip such that the scrim 30 contacts the supporting roller 54 and is positioned on the outer face of each layer in the wound package. In such position, it is believed that the scrim contributes at least to some degree in maintaining the above described circumferential tension upon the wound layers.

In accordance with the present invention, the distance between the rollers 52, 54 is controlled to a predetermined amount during the winding of the package upon the take-up roller to thereby exert a downwardly directed and equal biasing force upon each of the free ends of the roller 52 and thereby control the compression of the package layers. Preferably, this distance is increased by a constant amount during each rotation of the package such that the rollers separate a constant and predetermined amount which is less than the thickness of the sheet material upon each rotation of the package to thereby achieve a highly compact convolute package having a substantially uniform and predetermined layer to layer compression. By this arrangement, the compression within each layer may be selected within predetermined limits consistent with the desired compression of the overall package and without risk of detrimental over-compression of any layers.

The above control means includes a pair of cams 70 rotatably mounted on the frame (not shown), with each cam being positioned above one of the hold down brackets 56. More particularly, the two cams 70 are mounted for rotation with a rod 71 which defines a common axis and which is parallel to the axis of the supporting roller 54. In addition, the cams 70 have aligned and conforming cam outlines 72, with each outline comprising an inwardly facing U-shaped endless channel. A linkage is operatively positioned between each of the cam outlines 72 and the associated hold down brackets 56, whereby the cam outlines control the speed at which the take-up roller 52 is permitted to move upwardly. Each linkage comprises a cam follower 74 positioned within the cam outline of the associated cam, an upper bracket 75 slideably mounted on the frame, and means 76 interconnecting the upper bracket 75 and the hold down bracket 56. Also, the rod 71 and cams 70 carried thereby are operatively connected to the electric motor 60 by a suitable drive arrangement (not shown), such that the rod and cams are rotated at a speed coordinated with the speed of rotation of the supporting roller.

At the commencement of the winding operation, the take-up roller 52 and coaxially disposed cardboard core 41 are inserted into the apparatus such that the roller rests upon the supporting roller 54 and the ends of the roller 52 are positioned beneath the brackets 56. The sheet material 28 is then directed into the nip, and the forward end of the material is turned upon the roller 52 a couple of times by hand. Also, the cams 70 will be positioned as shown in FIG. 6, such that the followers 74 are on the low point of the cam outlines. The electric motor 60 is then energized to commence the rotation of the supporting roller 54 and the cams 70. As will be apparent from FIGS. 6 and 6A, the slope of the cam outlines 70 is more steep along its initial portion, and it gradually becomes less steep. By design, this predetermined slope permits the hold down brackets 56 to move upwardly a constant predetermined distance upon each rotation of the take-up roller 52 and the package formed thereon. The constant predetermined distance is less than the thickness of the sheet material, such that the hold down brackets 56 resist the upward movement of the roller 52, and thereby exert a downwardly directed force at each end thereof which serves to compress the sheet material as it passes through the nip. More particularly, the thickness of the sheet material is reduced by substantially more than one-quarter of its original non-compacted thickness, and preferably by at least about one-half of its original thickness. Thus for example, where a one-half inch thick web of foam sheet material is being wound, the rollers are preferably designed to separate a fixed distance of about one-quarter inch upon each rotation of the package, to thereby reduce the thickness of the web by one-half.

The application of an equal force at each end of the roller 52 in accordance with the present invention, results in a substantially uniform compressive force along the length of the nip. In this regard, the fact that the supporting roller 54 has a substantially uniform outer diameter throughout its length and thereby presents a non-interrupted line of contact along the full length of the nip results in a substantially uniform, continuous reduction in the thickness of the web across its full width as it passes through the nip. Thus a significantly higher degree of compression may be achieved as compared, for example, with the above described prior art apparatus having grooved rollers.

During the winding operation, the cams 70 travel through approximately 180° to the position shown in FIG. 6A, and when the desired final size is reached, the motor 60 is manually stopped and the sheet material 28 severed upstream of the nip. The free end of the sheet is then temporarily secured to the body of the package by means of the hand tied cords 43 as seen in FIG. 10, or by means of the sheet 46 of plastic film as seen in FIG. 11, for the purpose of securing the package in its wound condition and precluding the unwinding thereof. As a final production step, the take-up roller 52 and supported package are removed from the winding apparatus, and the roller slipped axially from the core 41.

While the method illustrated in FIGS. 6, 6A and 7 shows the winding of the sheet material 28 with a scrim 30, it will be understood that flexible foam sheet materials of other constructions, such as the material 24, may be formed into convolute packages with a comparable degree of compaction by the practice of the method described herein. Further, the thickness of the foam sheet material which may be employed with the present invention encompasses a rather wide range, but typically the thickness ranges between about one-quarter to one inch or more.

A package produced in accordance with the above described process has been found to exhibit several significant physical characteristics which materially enhance its commercial utility. As more fully discussed above, the package is substantially self-restrained against circumferential expansion and thus does not tend to radially expand upon the release of the binder. Further, the roll does not tend to unwind, either by unrolling along a floor or unwinding in a spring-like fashion (this property being illustrated in FIG. 4), and the recovery lag associated with the compacted rolls of the prior art has been eliminated, thereby permitting immediate use of the web in forming components of predetermined size therefrom.

A further and significant feature of the present invention resides in the fact that each layer in the package is substantially uniformly compressed by reason of the fact that the distance between the rollers is permitted to increase a fixed predetermined distance upon each rotation of the package, and the fact that the separation of the rollers may be accurately controlled to in turn control the degree of compression in each foam layer. This permits packages having a given length of foam sheet material therein to have a substantially consistent outside diameter which is predetermined for optimum packing of a number of the packages during shipment or storage. Also, maximum compression of the overall package may be obtained while avoiding variations in compression from layer to layer which could result in areas of detrimental over-compression. As noted above, such over-compression can result in a significant lag in the recovery of the full thickness dimension of the foam sheet material upon unwinding of the package, which in turn can preclude the immediate use of the foam in certain instances. In addition, over-compression can result in the destruction of the cellular foam structure, and thus permanent non-uniformity in the thickness and appearance of the foam sheet material after unwinding of the roll.

Further details of the method and apparatus for forming the package of the present invention may be obtained by reference to the applicant's above noted copending application Ser. No. 653,483 entitled "Method and Apparatus for Forming Convolute Foam Package".

In the drawings and specification, there has been set forth a preferred embodiment of the invention, and although specific terms are employed, they are used in a generic and descriptive sense only and not for purposes of limitation.

That which is claimed is:

1. A highly compact convolute package of flexible foam sheet material, said package being characterized by substantially uniform layer to layer compression within predetermined limits consistent with the desired compression of the overall package and without detrimental over-compression of any layers, and by substantial self-restraint against circumferential expansion to facilitate handling and unwinding thereof, and the sheet material thereof being characterized by substantial dimensional stability in the length and width directions so as to permit use of the sheet material, for example, immediately upon the subsequent unwinding thereof in the formation of components of predetermined size, said package having a predetermined length of highly compressible, flexible foam sheet material arranged in a plurality of convolute layers, said layers being substantially wrinkle-free, and having a width dimension closely corresponding to the width of the sheet material in unwound non-compacted form, the thickness of said layers being substantially uniform from layer to layer within said predetermined limits and being substantially less than three-quarters of the thickness of the non-compacted sheet material and the volume of said package being substantially less than nine-sixteenths the volume the package would occupy in a non-compacted, convolutely wound form.

2. A highly compact convolute package of flexible foam sheet material, said package being characterized by substantially uniform layer to layer compression within predetermined limits consistent with the desired compression of the overall package and without detrimental over-compression of any layers, and by substantial self-restraint against circumferential expansion to facilitate handling and unwinding thereof, and the sheet material thereof being characterized by substantial dimensional stability in the length and width directions so as to permit the use of the sheet material, for example, immediately upon the subsequent unwinding thereof in the formation of components of predetermined size, said package having a core, and a predetermined length of highly compressible, flexible foam sheet material arranged in a plurality of convolute layers upon said core, said foam sheet material having a thickness of at least about one-quarter inch in a relaxed non-compacted form, said layers being substantially wrinkle-free, and having a width dimension closely corresponding to the width of the sheet material in unwound non-compacted form, the thickness of said layers being substantially uniform from layer to layer within said predetermined limits and being substantially less than the thickness of the non-compacted sheet material.

3. The convolute package as defined in claim 2 wherein said foam sheet material has a thickness substantially less than three-quarters of the thickness of the non-compacted sheet material and the volume of the package is substantially less than nine-sixteenths the volume the package would occupy in a non-compacted, convolutely wound form.

4. The convolute package as defined in claim 2 wherein said foam sheet material has a thickness of at least about one-half inch in a relaxed non-compacted form, and the volume of the package is not greater than one-half the volume the package would occupy in a non-compacted convolutely wound form.

5. The convolute package as defined in claim 2 further comprising securing means engaging the outer layer of the wound sheet material for maintaining the package in its wound form to preclude the inadvertent unwinding of the package during handling.

6. A highly compact convolute package of flexible foam sheet material, said package being characterized by substantially uniform layer to layer compression within predetermined limits consistent with the desired compression of the overall package and without detrimental over-compression of any layers, and by substantial self-restraint against circumferential expansion to facilitate handling and unwinding thereof, and the sheet material thereof being characterized by substantial dimensional stability in the length and width directions so as to permit the use of the sheet material, for example, immediately upon the subsequent unwinding thereof in the formation of components of predetermined size, said package having a cylindrical core, and a predetermined length of flexible sheet material arranged in a plurality of convolute layers upon said core, said sheet material comprising a sheet of highly compressible cellular foam having a thickness of at least about one-quarter inch in a relaxed non-compacted form, and a sheet of reinforcing material secured to the outside face of the foam sheet, said layers being substantially wrinkle-free, and having a width dimension closely corresponding to the width of the sheet material in unwound non-compacted form, the thickness of said layers being substantially uniform from layer to layer within said predetermined limits and being not greater than about one-half the thickness of the non-compacted sheet material, and the volume of said package being not greater than about one-quarter the volume the package would occupy in a non-compacted, convolutely wound form.

* * * * *